United States Patent [19]

McDonald et al.

[11] 4,056,963

[45] Nov. 8, 1977

[54] MEANS OF DETERMINING EXTRUSION TEMPERATURES

[75] Inventors: Robert E. McDonald, Oliver Springs; Domenic A. Canonico, Oak Ridge, both of Tenn.

[73] Assignee: The United States of America as represented by the United States Energy Research and Development Administration, Washington, D.C.

[21] Appl. No.: 752,944

[22] Filed: Dec. 21, 1976

[51] Int. Cl.[2] ..... B23C 23/08

[52] U.S. Cl. ..... 72/253 R; 72/271; 72/342; 73/339 R

[58] Field of Search ..... 72/253, 254, 257, 271, 72/342; 73/339 R; 116/114.5; 148/128, 12 B, 12 R, 11.5

[56] References Cited

U.S. PATENT DOCUMENTS

| | | | |
|---|---|---|---|
| 2,171,180 | 8/1939 | Jones | 72/253 |
| 2,671,559 | 3/1954 | Rosenkranz | 72/253 |
| 3,798,942 | 3/1974 | Brackow | 72/253 |
| 3,839,898 | 10/1974 | Talboom, Jr. et al. | 73/339 R |

*Primary Examiner*—C.W. Lanham
*Assistant Examiner*—Daniel C. Crane
*Attorney, Agent, or Firm*—Dean E. Carlson; Stephen D. Hamel; Louis M. Deckelmann

[57] ABSTRACT

In an extrusion process comprising the steps of fabricating a metal billet, heating said billet for a predetermined time and at a selected temperature to increase its plasticity and then forcing said heated billet through a small orifice to produce a desired extruded object, the improvement comprising the steps of randomly inserting a plurality of small metallic thermal tabs at different cross sectional depths in said billet as a part of said fabricating step, and examining said extruded object at each thermal tab location for determining the crystal structure at each extruded thermal tab thus revealing the maximum temperature reached during extrusion in each respective tab location section of the extruded object, whereby the thermal profile of said extruded object during extrusion may be determined.

2 Claims, 3 Drawing Figures

MEANS OF DETERMINING EXTRUSION TEMPERATURES

BACKGROUND OF THE INVENTION

This invention was made in the course of, or under, a contract with the Energy Research and Development Administration.

Extrusion is the preliminary step commonly used to shape metals into wires, tubes, long sheets and other shapes. In this process, a cylindrical metal object, known as a billet, is usually heated to a specified temperature to reduce the amount of work needed for deformation by increasing its plasticity. The billet is then forced through a small orifice producing a sudden deformation of the billet. A by-product of this deformation is heat. The temperature of the extrusion product during extrusion varies with its length due to the fact that, as heat is created by deformation, heat from the preheat step is also lost to the environment. Therefore, the maximum heat occurs near the front end of the extrusion product before much heat is transferred to its surroundings.

Up to the present invention, there has been no way to determine the maximum temperature, or the temperature distribution, attained in the extrusion product during extrusion. This temperature can be very critical in some applications because a phase change in the crystal structure of the extrusion product may occur during extrusion which could greatly vary the characteristics of the product.

Thus, there exists a need for some method and/or means for determining the maximum temperature as well as other temperatures attained in materials during an extrusion thereof such that the extrusion process can be properly controlled to provide an end product with a desired crystal structure. The present invention was conceived to meet this need in a manner to be described hereinbelow.

SUMMARY OF THE INVENTION

It is the object of the present invention to provide a method for determining the temperatures attained in materials during an extrusion thereof to provide an extrusion product produced with a desired thermal profile and consequently a desired crystal structure.

The above object has been accomplished in the present invention by inserting a plurality of small metallic wires or thermal tabs at different cross sectional depths and axial positions in a billet during fabrication thereof, such that when the billet is subsequently heated and extruded, the extruded product may be examined at each thermal tab location for determining the crystal structure of each extruded tab thus revealing the maximum temperature reached in each respective tab location section during extrusion, wherein the thermal profile attained by the extruded product can be determined, and the rate of extrusion can thus be varied to achieve substantially isothermal extrusion of subsequent billets.

DESCRIPTION OF THE PREFERRED EMBODIMENT

Figure 1:
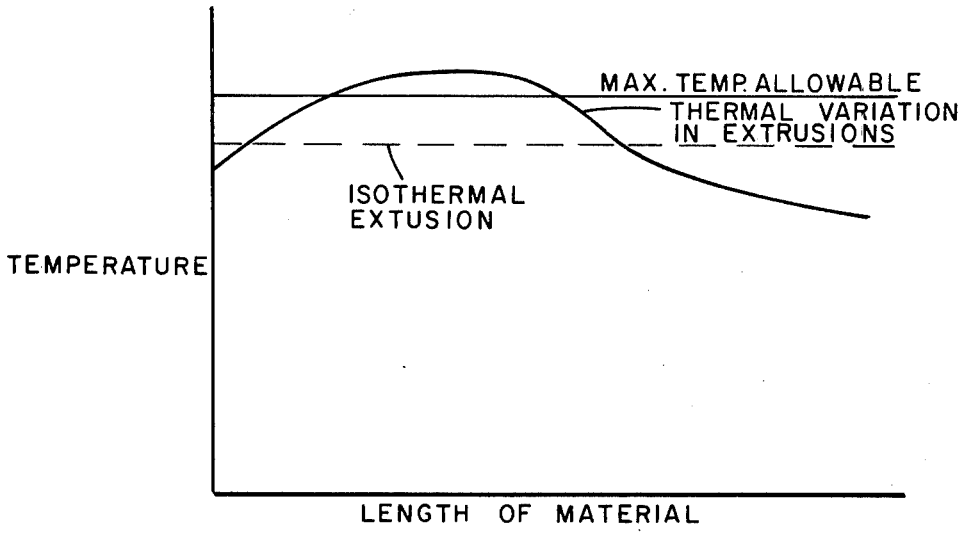
FIG. 1 is a sketch of the typical variation in temperature with respect to the length of a material during extrusion.

FIG. 1 illustrates a typical variation in temperature with respect to the length of a material during extrusion. This temperature distribution varies with the type of material used for the extrusion. The temperature profile, in the case shown, indicates that a portion of the billet attained a temperature in excess of the maximum allowable temperature. The broken line is the desired temperature during the extrusion process. The present invention relates to a method for determining the thermal profile, during extrusion, of a sample extruded product such that the rate of extrusion of subsequent extruded products can be varied to achieve substantially isothermal extrusion.

The present invention will be described in relation to the extrusion of materials used to make superconducting wire. However, it should be understood that the principles of the present invention can be utilized in the extrusion of any desired materials.

Figure 2:
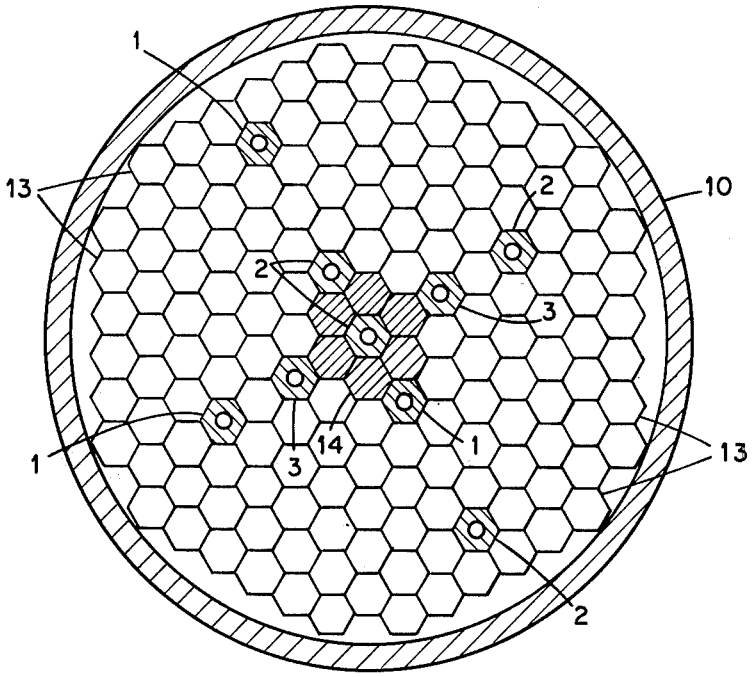
FIG. 2 is a cross sectional view of a billet used to make superconducting wire along the line 2—2 of FIG. 3.
Figure 3:
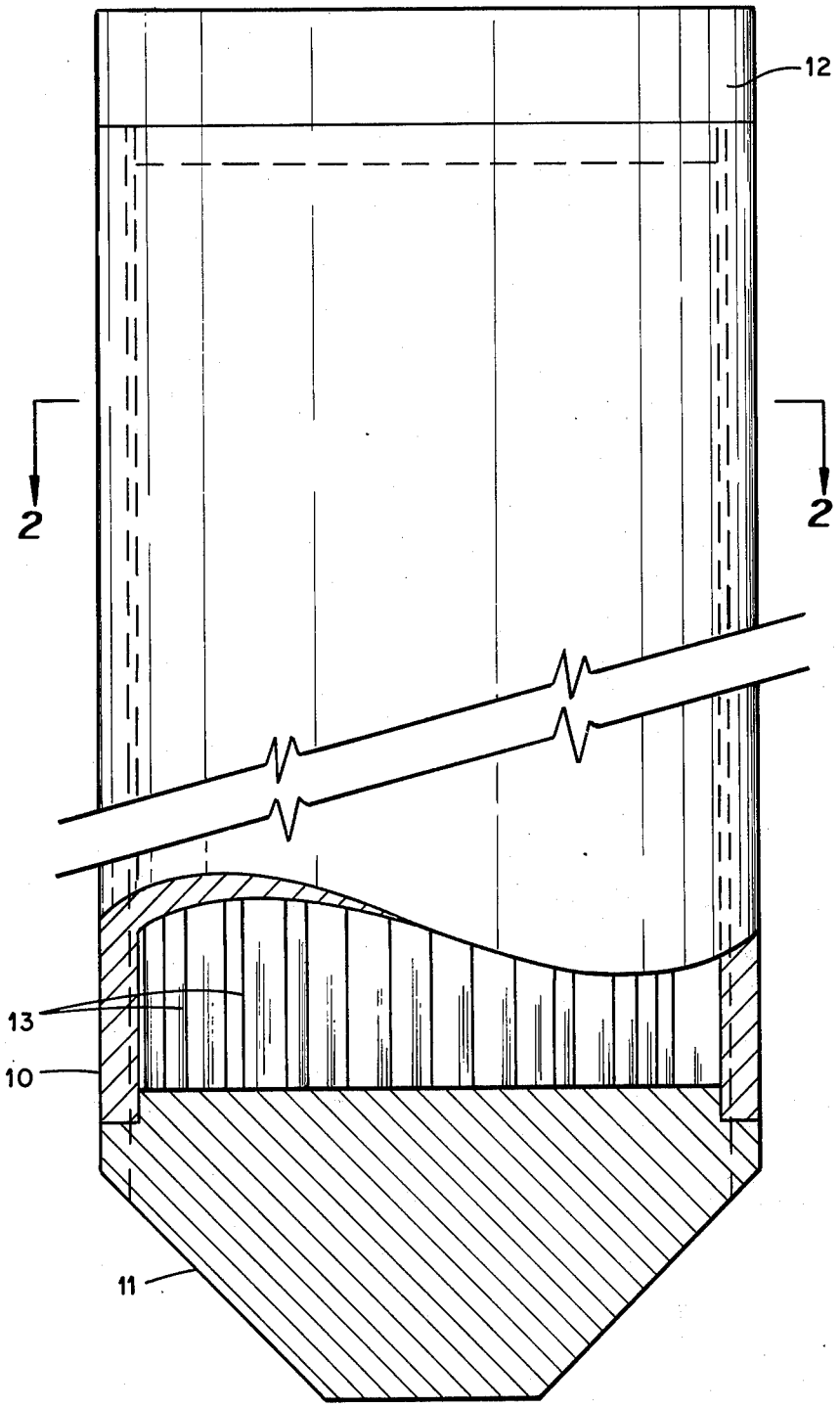
FIG. 3 is a longitudinal view of the billet.

In the extrusion of materials used to make superconducting wire, the billet for such a purpose typically is composed of a large number (e.g., 156) hexagonal outer elements 13 and a smaller number (e.g., 7) of hexagonal center elements 14 as illustrated in FIG. 2 of the drawings, with all of the elements enclosed within a cylindrical housing 10. As shown in FIG. 3, the housing of the billet is provided with a nose 11 and an end plug 12 affixed thereto by any conventional means such as by electron beam welds.

The core of the outer elements 13 is composed of niobiumtitanium (NbTi), and the body of these elements is made of copper. The housing members 10, 11, and 12, and the center elements 14 are composed of copper-nickel alloy (70 Cu-30 Ni). The billet as shown in FIG. 3 is four inches in diameter and has a cylinder length of twelve inches, for example. The tapered nose 11 of the billet eases its advance in the initial stage of extrusion.

Thermal tabs composed of 1008 steel (Fe-0.08C) are provided as part of selected ones of the outer elements 13 and of at least one of the center elements 14 during fabrication of the sample billet. As used herein, the term "thermal tab" refers to a material whose crystal structure changes noticably as a function of temperature. These tabs have the same cross-sectional size as the elements they are made a part of and are held by retainers that are ¼ inch in length. Three of the thermal tabs are randomly placed eleven inches from the end 12 of the billet in outer elements 13 at the positions 1 as shown in FIG. 1; 4 of the tabs are placed 5-⅞ inches from the end 12 of the billet in three outer elements 13 and one center element 14 at the positions 2 in FIG. 2; and 2 of the tabs are placed ⅞ inch from the end 12 in outer elements 13 at the positions 3 in FIG. 2. It should be understood that the above number of tabs and their respective positions in selected ones of the elements are by way of example only, and that additional tabs and other placements thereof in other ones of the elements may be provided and utilized if such is desired or necessary.

The thermal tabs have physical characteristics relative to their crystal structure that are well established and which will enable the user to determine if any portion of the extrusion product exceeded the maximum allowable temperature considered satisfactory for the superconducting wire. In order to insure that the temperature of the billet has not exceeded its maximum allowable temperature in the preheat stage, another sample billet is fabricated with thermocouples in the same locations as the thermal tabs in the previous sample billet. It can be proven that the billet containing the thermal tabs did not exceed 1250° F in the preheat stage by placing both billets in a furnace side by side. If the thermocouples show that the billet did not exceed the critical temperature, then any phase changes that occur in the thermal tabs after extrusion must have occured during the extrusion process. The billet containing the thermal tabs is extruded with a reduction ratio of sixteen to one. One extrusion press that may be utilized is a Watson Stillman 1260 ton horizontal press, for example. The time that elapses between the removal of the billet from the furnace to the end of the extrusion process is on the order of 1 minute. The actual extrusion process takes about 40 seconds.

The extruded product is then cut, polished, and examined in both the longitudinal and transverse direction at each thermal tab location. The crystal structure of the tabs will reveal the maximum temperatures reached in the respective particular sections of the billet since the crystal structure of the tabs is a function of the temperature reached thereby during the extrusion process. By using the thermal tabs at different cross sectional depths in the billet, it is thus possible to determine the variation of temperature throughout the sample extruded product, and a thermal profile of the product can be drawn (as in FIG. 1). Thus, knowing the temperature distribution from a sample extrusion product, the rate of extrusion for subsequent extrusions could be varied to achieve substantially isothermal extrusion.

The use of small metallic thermal tabs, having structural characteristics that are well established, as described above, provides an accurate method for determining the maximum and minimum temperatures obtained in materials during the extrusion thereof. It should be noted and understood that an accurate determination of the temperatures obtained in the above same materials in an extrusion thereof, without the use of thermal tabs, would be difficult to achieve due to the fact that the use of the several metals utilized in the extrusion of a superconducting wire would result in an extruded product that would not have uniform or known structural characteristics, wherein it would be difficult (it not impossible) to achieve an accurate thermal profile of the extruded product.

It should be understood that the materials to be used as thermal tabs is not limited to the specific material mentioned hereinabove since it can and will vary depending on the temperature that it is desired to monitor. For example, another material, which could very possibly be used as thermal tabs is pure aluminum.

This invention has been described by way of illustration rather than by limitation and it should be apparent that it is equally applicable in fields other than those described.

What is claimed is:

1. In an extrusion process comprising the steps of fabricating a metal billet, heating said billet for a predetermined time and at a selected temperature to increase its plasticity, and then forcing said heated billet through a small orifice of an extrusion press to produce a desired extruded product, the improvement comprising the steps of randomly inserting a plurality of small metallic thermal tabs at different cross sectional depths and axial positions in said billet as a part of said fabricating step, and examining said extruded product at each thermal tab location for determining the crystal structure of each extruded thermal tab thus revealing the maximum temperature reached in each respective tab location section of the extruded product during extrusion, whereby the thermal profile of said extruded product may be determined.

2. The process set forth in claim 1, wherein the complete extrusion process is periodically repeated for respective subsequent billets, and the rate of extrusion by said press is varied as a function of said thermal profile to substantially achieve isothermal extrusion of said subsequent billets.

* * * * *